US007328599B2

(12) United States Patent
Van Nguyen

(10) Patent No.: US 7,328,599 B2
(45) Date of Patent: Feb. 12, 2008

(54) METHOD AND APPARATUS FOR MAKING METAL BALL BATS

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 247 days.

(21) Appl. No.: 11/307,353

(22) Filed: Feb. 2, 2006

(65) Prior Publication Data

US 2007/0175014 A1 Aug. 2, 2007

(51) Int. Cl.
*B21B 15/00* (2006.01)
*B21B 21/06* (2006.01)

(52) U.S. Cl. ..... 72/206; 72/208; 72/283; 72/402; 72/370.25

(58) Field of Classification Search ..... 72/76, 72/206, 208, 214, 283, 370.01, 370.02, 370.25, 72/402

See application file for complete search history.

(56) References Cited

U.S. PATENT DOCUMENTS

| | | | | |
|---|---|---|---|---|
| 459,765 | A | | 9/1891 | Parmelee |
| 545,513 | A | | 9/1895 | Mannesmann |
| 556,013 | A | | 3/1896 | Mannesmann |
| 1,611,858 | A | | 12/1926 | Middlekauff |
| 2,005,657 | A | | 6/1935 | Ludwig |
| 2,680,391 | A | | 6/1954 | Kaiser |
| 3,650,138 | A | | 3/1972 | Persico |
| 3,691,625 | A | * | 9/1972 | Swenck ..... 29/557 |
| 3,717,458 | A | * | 2/1973 | Lesko ..... 72/276 |
| 3,807,213 | A | * | 4/1974 | Willis et al. ..... 72/283 |
| 3,834,698 | A | * | 9/1974 | Pouzou ..... 473/566 |
| 4,038,850 | A | * | 8/1977 | Sakagami ..... 72/85 |
| 4,089,199 | A | | 5/1978 | Siemonsen |
| 4,184,352 | A | | 1/1980 | Potapov et al. |
| 4,602,493 | A | | 7/1986 | Dobrucki et al. |
| 4,674,312 | A | | 6/1987 | Cook |
| 4,827,749 | A | | 5/1989 | Staat et al. |
| 5,074,555 | A | * | 12/1991 | Meredith ..... 473/323 |
| 5,125,251 | A | | 6/1992 | Pettersson et al. |
| 5,626,050 | A | | 5/1997 | Ploughe et al. |
| 6,735,998 | B2 | | 5/2004 | Mitchell |

FOREIGN PATENT DOCUMENTS

| | | |
|---|---|---|
| JP | 4-319007 | * 11/1992 |

* cited by examiner

*Primary Examiner*—Daniel C Crane
(74) *Attorney, Agent, or Firm*—Kelly Lowry & Kelley LLP

(57) ABSTRACT

A process for manufacturing a hollow metal ball bat includes forming a shell into a tubular shape using a pilger mill. The wall thickness of the tube shell is reduced by drawing the tube shell with the draw bench. A handle section and a taper section are created using the pilger mill. The handle is drawn through a draw bench, and the handle and taper sections are swaged.

24 Claims, 10 Drawing Sheets

FIG. 12
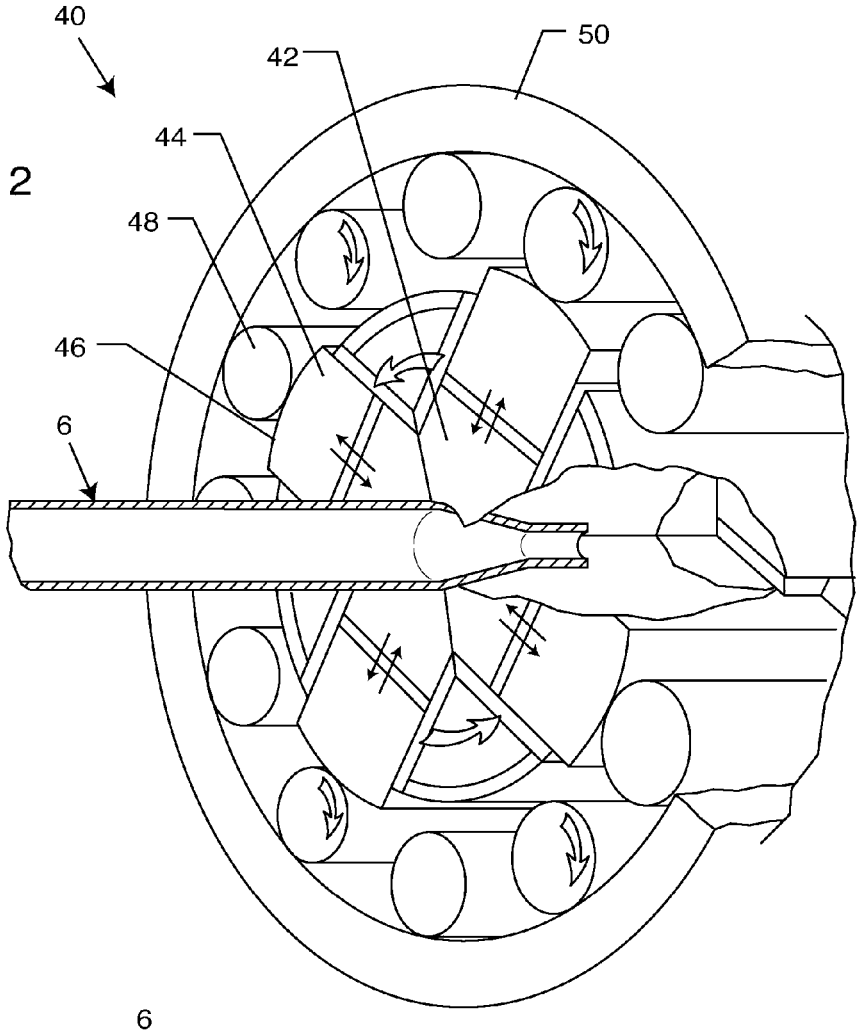
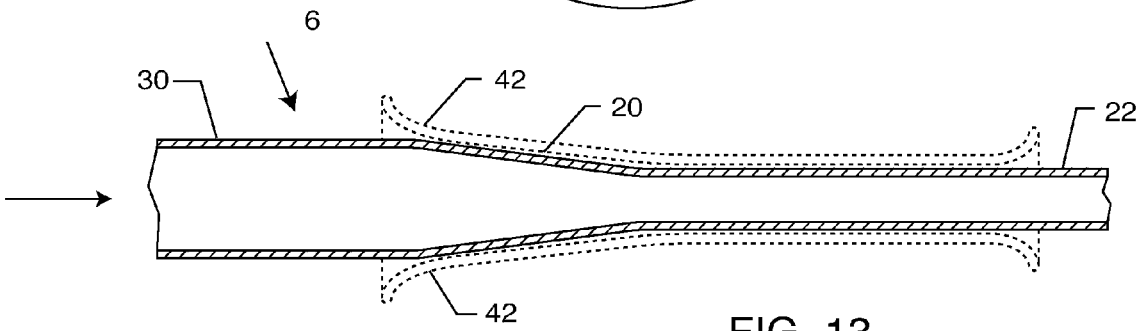
FIG. 13

METHOD AND APPARATUS FOR MAKING METAL BALL BATS

BACKGROUND OF THE INVENTION

The present invention generally relates to a method for making hollow metal ball bats. More particularly, the present invention relates to a method for making metal ball bats using a pilger mill, a draw bench, and a rotary swager in combination to obtain a perfect roundness and wall uniformity for the handle and taper sections of the bat.

The methods of manufacturing ball bats and improvements in the design and materials have been the subject of numerous patents over the years, most directed to ball bats used in games of baseball and softball. The baseball bat was initially made of wood, and to this day, ball bats used in professional baseball leagues are exclusively made of hard woods. However, over the years, there has been a great increase in the number of ball bats to meet the demand for the increasingly popularity of the sport, including semi-professional, college, little league and baseball and softball organized leagues. Metal bats have been increasingly used as substitutes for wooden bats because of their light weight, and while metal bats typically cost more than wooden bats, they have the great advantage of lasting longer, and hence of costing less in the long run.

An early approach, such as disclosed by U.S. Pat. No. 1,611,858 to Middlekauff, was to make a ball bat from tapered steel tube, formed by a rolled tapered sheet with mating edges joined along a seam to form the tube. However, it soon became apparent that seamless lightweight metal tubing, such as aluminum or titanium, was preferred. This is due to the fact that the metal bat should closely resemble the operating characteristics of a wood bat, so as to exhibit the weight distribution, feel, and sound of the wood bat when hitting the ball.

Early efforts to develop aluminum bats included the approach of swaging down the length of a cylindrical extrusion or tube. The extrusion is swaged down by striking or contacting the member with clapping hammers, which repetitively strike the outer surface of the extrusion. The striking motion is perpendicular to the longitudinal axis of the tube which causes the exterior diameter of the tube to be reduced, thus forming an intermediate tapered portion, or trumpet, and handle end of the ball bat. While generally having a smooth outer surface, it was discovered that the interior surface of the ball bat formed by this method was less than smooth, and could have cracks or fractures running parallel to the longitudinal axis of the ball bat. Of course, these cracks weakened the bat and reduced its longevity. Moreover, the swaging process did not result in a uniform wall thickness of the tapered or trumpet section. The increased wall thickness added to the weight of the bat, and did not contribute to the strength of the bat as it displaced the center of gravity of the bat away from the hitting end of the bat.

In an effort to overcome these disadvantages, Ploughe et al., as disclosed in U.S. Pat. No. 5,626,050, developed a methodology of forming a hollow metal ball bat using a cold pilger process. An aluminum tube blank is fixed into a "pusher", the pusher having a cylindrical opening having a diameter slightly larger than the outer diameter of the tube blank. The pusher and threaded extension rod are then used to advance the aluminum tube blank into a pilger mill, also referred to as a reducing rolling mill. This reduces the aluminum tube to form the handle section and the tapered section, and thereby form the bat-shaped stock for fabricating a hollow metal ball bat.

However, this procedure also has its disadvantages. The use of an adapter, a pusher, and threaded extension rod has been found to be unsafe, inefficient, and time consuming. This process has also used a partial, typically half, ring die set, which generates a significant amount of heat when reducing the tubes. Although the use of an internal mandrel is useful to control the tube wall thickening as compared to the swaging process, it significantly added to the metal working costs and greatly increased the stress in the machinery used to reduce the outside diameter of the tube.

U.S. Pat. No. 6,735,998 to Mitchell appreciated the disadvantages of forming hollow metal ball bats using either a swaging or a cold pilgering process. In order to overcome these disadvantages, Mitchell proposed a process for forming ball bats by the use of drawing a blank only partly through a contoured die, or a succession of contour dies. By only reducing the diameter of essentially only a select length of the tubular metal blank by the use of tension plied to pull the metal blank in a die or a succession of dies, Mitchell asserted that an intermediate annealing step could usually be eliminated and a thinner tube wall in the handle and transition for trumpet sections of the ball bat obtained.

The inventor has discovered that each of the swaging, cold pilgering, and draw processes present both advantages as well as disadvantages. Accordingly, there is a continuing need for a process for manufacturing a hollow metal ball bat utilizing a combination of processes so as to synergistically create a better ball bat and an improved manufacturing process. The present invention fulfills these needs and provides other related advantages.

SUMMARY OF THE INVENTION

The present invention resides in a process for manufacturing a hollow metal ball bat, and particularly a barrel section, a taper section, and a handle section of the bat, using a plurality of different processes. The combination of processes have been found to create a ball bat having a superior surface smoothness on hard aluminum alloy, as well as more uniform and precision wall thickness for the handle and taper sections. These characteristics enhance the durability of the handle, and minimize premature breakage when a bat is in use.

The process generally comprises the steps of forming a shell into a tubular shape using a pilger mill. This forming step results in the tube shell have a generally uniform outer diameter and wall thickness.

The tube shell is then cut into predetermined lengths. The tube shell is then drawn over a mandrel of a draw bench to reduce the wall thickness of the tube shell. Typically, the tube shell is annealed after this reducing step.

A handle and taper sections of the ball bat are created using a pilger mill. The tube shell is rotated along a longitudinal axis thereof as a full-ring die set of the pilger mill is actuated along a length of the tube shell. The tube shell is clamped to the pilger mill using an internal diameter tube clamp device. The tube shell is rotated step-wise in approximately 41 degree increments while being advanced into the die set. The full-ring die set is actuated along the section of the tube shell for between five and fifteen seconds. The full-ring die set is actuated along the length of the tube shell in such a manner so as to cause material flow of the tube shell in the same direction of work load during actuation strokes of the die set. The tube shells are then typically annealed and cleaned.

The handle is then drawn using a draw bench. This includes advancing the tube shell having a mandrel disposed therein through a die ring located inside of a die block of the draw bench.

The handle and taper sections of the tube shell are then swaged. The tube shell is cut to a final length after the swaging step, and heat treated. A knob is attached onto a handle end of the tube shell, and an end cap on an opposite of the tube shell, and it is decorated, etc., to complete the bat.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 12 is a partially sectioned and fragmented perspective view of a rotary swaging machine used to swage the handle and taper sections of the shell.

FIG. 13 is a cross-sectional view illustrating the handle and taper sections being swaged.

DETAILED DESCRIPTION OF THE PREFERRED EMBODIMENTS

As shown in the accompanying drawings, for purposes of illustration, the present invention resides in a process for making hollow metal ball bats, such as those used in baseball and softball. As will be more fully described herein, the present invention utilizes a combination of processes, namely, pilgering, drawing, and swaging processes to form a tube shell and contour it into the final shape and dimension of the baseball or softball bat. As described above, while these individual processes each have their own advantages and disadvantages, the Applicant believes that by combining the processes in order to complete the bat, the advantages have a synergistic effect so as to create a final bat which has superior roundness, wall uniformity for the handle and taper sections, and strength.

Figure 1:
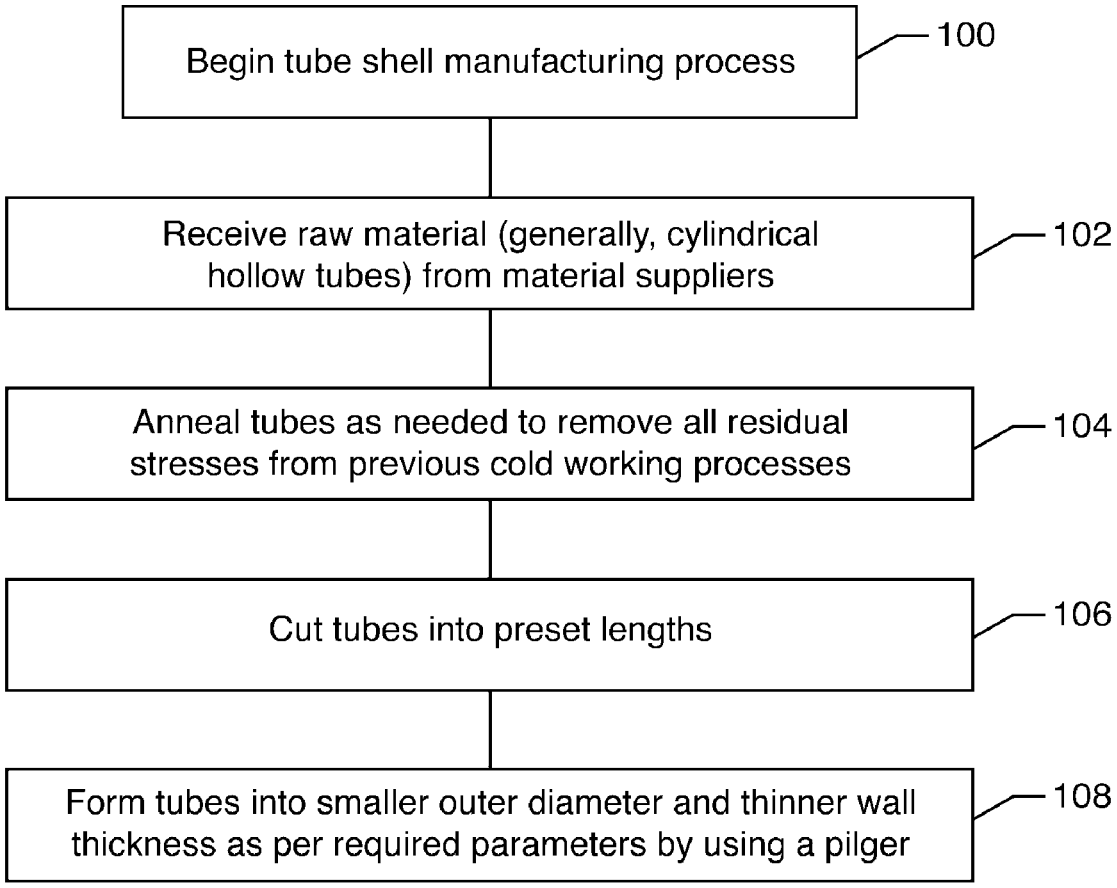
FIG. 1 is a flow chart depicting the steps taken in accordance with the present invention to form a tube shell.

With reference now to FIG. 1, one begins the tube shell manufacturing process (100) by receiving raw material, typically cylindrical hollow tubes, from material suppliers (102). The raw material, typically extruded cylindrical hollow tubes, typically need to be annealed to remove all residual stresses from previous cold working processes (104). The tubes are then cut into preset lengths (106).

The tube shells are then formed into smaller outside diameter (OD) and thinner wall thickness as per the required parameters for the intended baseball or softball bat using a pilger mill, also known as a tube reducer (108). The cylindrical tube shells are formed with uniform outside diameter and wall thicknesses from end to end using the pilger mill. As is known in the art, cold pilgering is a tube reducing process under the action of pressure in three directions. The wall of the tube is squeezed in cold condition between a pair of outside tools, referred to as dies, and an internal tool, known as a the mandrel.

Figure 7:
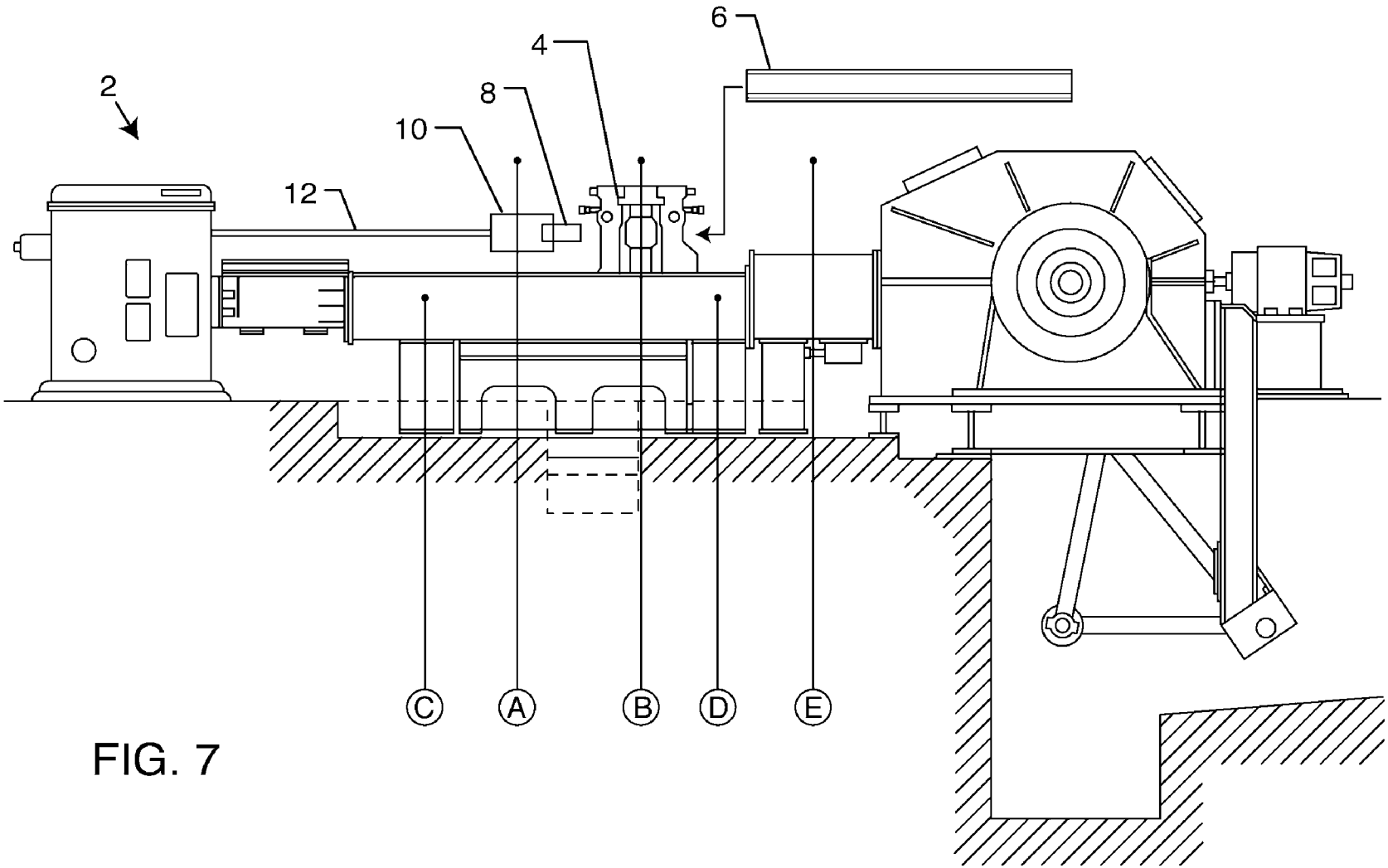
FIG. 7 is a diagrammatic view of a pilger mill used in accordance with the present invention to form a tube shell in a tubular shape.

With reference now to FIG. 7, an exemplary pilger mill 2 is shown. The reference characters A-E illustrated in FIG. 7 will be used to describe the positioning of various components of the pilger mill 2 during the processes, as described more fully herein. The pilger mill 2 includes a saddle assembly 4 which receives the hollow shell tube 6 therein. Within the saddle assembly 4 are disposed a set of full-ring dies, as will be more fully described herein. Briefly, the full-ring die on a vertical mass reciprocating machine design is utilized so as to allow for a longer bat design, improve the mechanical properties of the bat product material, typically an aluminum alloy, and eliminate any heat build up of the tube shell or bat during the pilgering process. When the tube shell 6 is inserted through the saddle assembly 4, it is clamped and engaged into place utilizing an internal clamp device 8, which secures the tube shell 6 within the open end of the tube shell 6. The internal clamp device 8 is connected to a carriage assembly 10, which is engaged with a mandrel rod 12 which is connected to a portion of the pilger mill 2 which rotates the rod 12 in a controlled and selective manner so as to rotate the tube shell 6, as will be more fully described herein.

In operation, dies oscillate along a certain stroke length and perform an oscillatory rotatory movement at the same time. The latter is forced by a pinion on each roll shaft, which is in contact with a rack mounted in the machine housing, as is known by those skilled in the art. As the cross section between the dies and the mandrel is decreasing along the stroke, the cross section of the tube is reduced simultaneously. With every stroke, ingoing tube material is fed into the rolling area, so that another volume of ingoing tube can be reduced down to finished tube dimension. The cold pilgering process allows large cross sectional reduction in one step, very tight tolerances of the finished product's diameter and wall thickness, significant reduction of eccentricity, and the achievement of special material microstructures. Generally, as is known in the art, the pilgering sequences to feed the tube cell 6 into the cold pilger mill 2 over a mandrel and through a die set, to achieve a set reduction of area and finished tube size. As will be more fully described herein, the cold working takes place as the die sets roll down the material between the dies and a mandrel, the tubing having a finished desired reduction of area, finish diameter and wall thickness. A benefit of the internal inside diameter tube clamp device 8 is that when the process is finished, the tube clamp when released, pushes the finished tube or bat product off of the mandrel, therefore no extension rods, or other mechanisms must be used or manipulated in order to remove the tube shell 6. Moreover, by using a full-ring die set and long stroke, the treated tube shell 6 will be sufficiently cold so as to be handled manually by a worker, whereas only partial die sets and shorter strokes, such as that illustrated and disclosed in U.S. Pat. No. 5,626,050, are much hotter and are much more difficult to remove from the pilgering mill tube.

Figure 2:
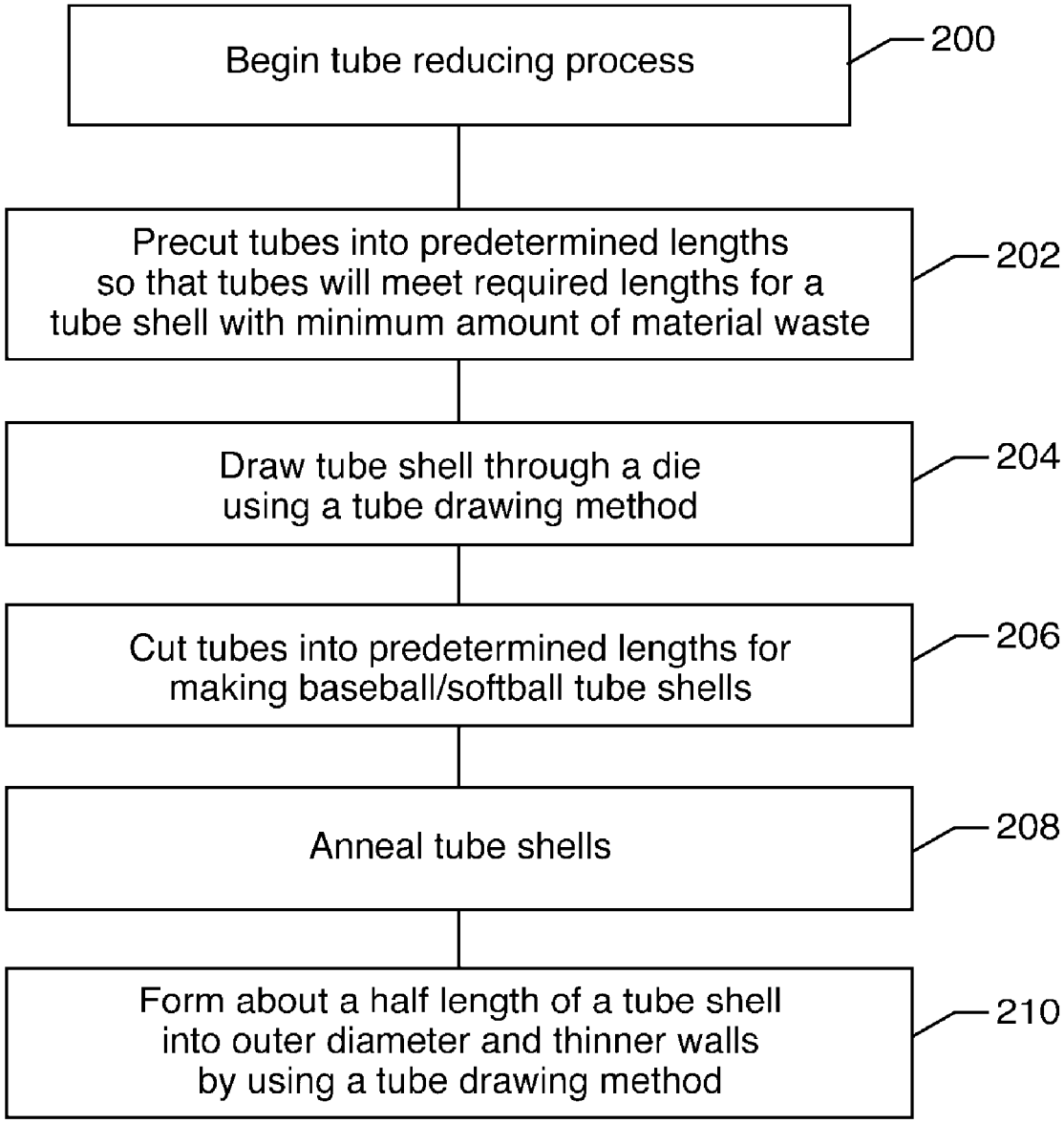
FIG. 2 is a flow chart depicting the steps taken in accordance with the present invention for drawing a tube shell through a draw bench.

With reference now to FIG. 2, to begin the tube reduction process (200), the tubes are first precut into predetermined lengths, so that the tubes will meet required lengths for a tube shell with minimum amount of material waste (202). The cut tube and previously pilgered tube shell are then drawn through a die using a tube drawing method (204). More particularly, the tube shell is drawn through a die over a mandrel to form thinner wall thickness tubes, as per required parameters, using a tube drawing method.

The shell tubes are then cut again into predetermined lengths for making baseball or softball tube shells (206). These tube shells are then annealed (208). If needed, about half the length of the tube shell is then formed into a smaller outer diameter and thicker wall thickness using a tube drawing method (210). This step avoids excessive outer diameter and wall thickness reduction in subsequent steps. However, excessive reduction will cause cracks or other structural damages to a shell.

Figure 3:
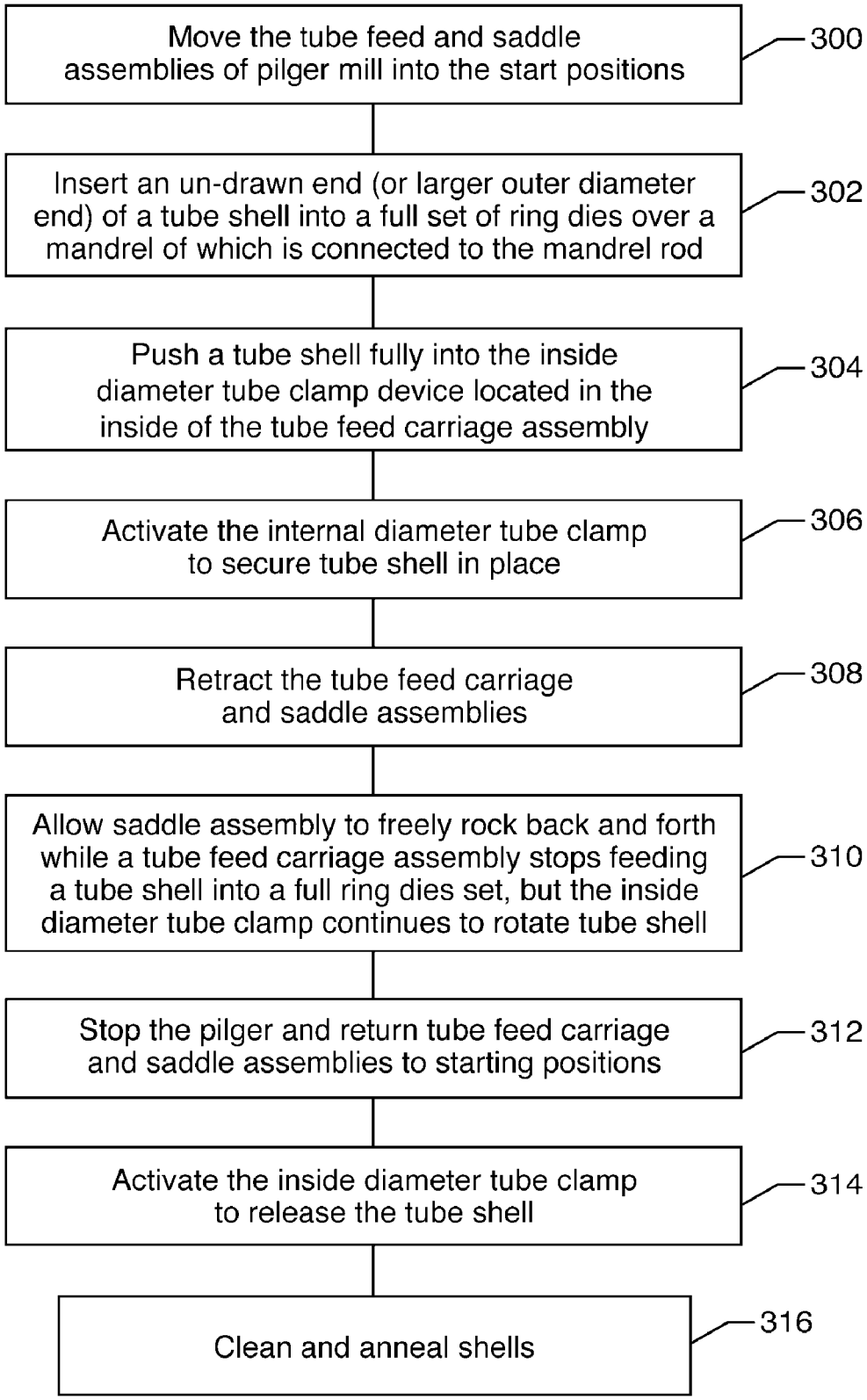
FIG. 3 is a flow chart depicting the steps taken in accordance with the present invention to form a handle and taper section of the tube shell with a pilger mill.
Figure 8:
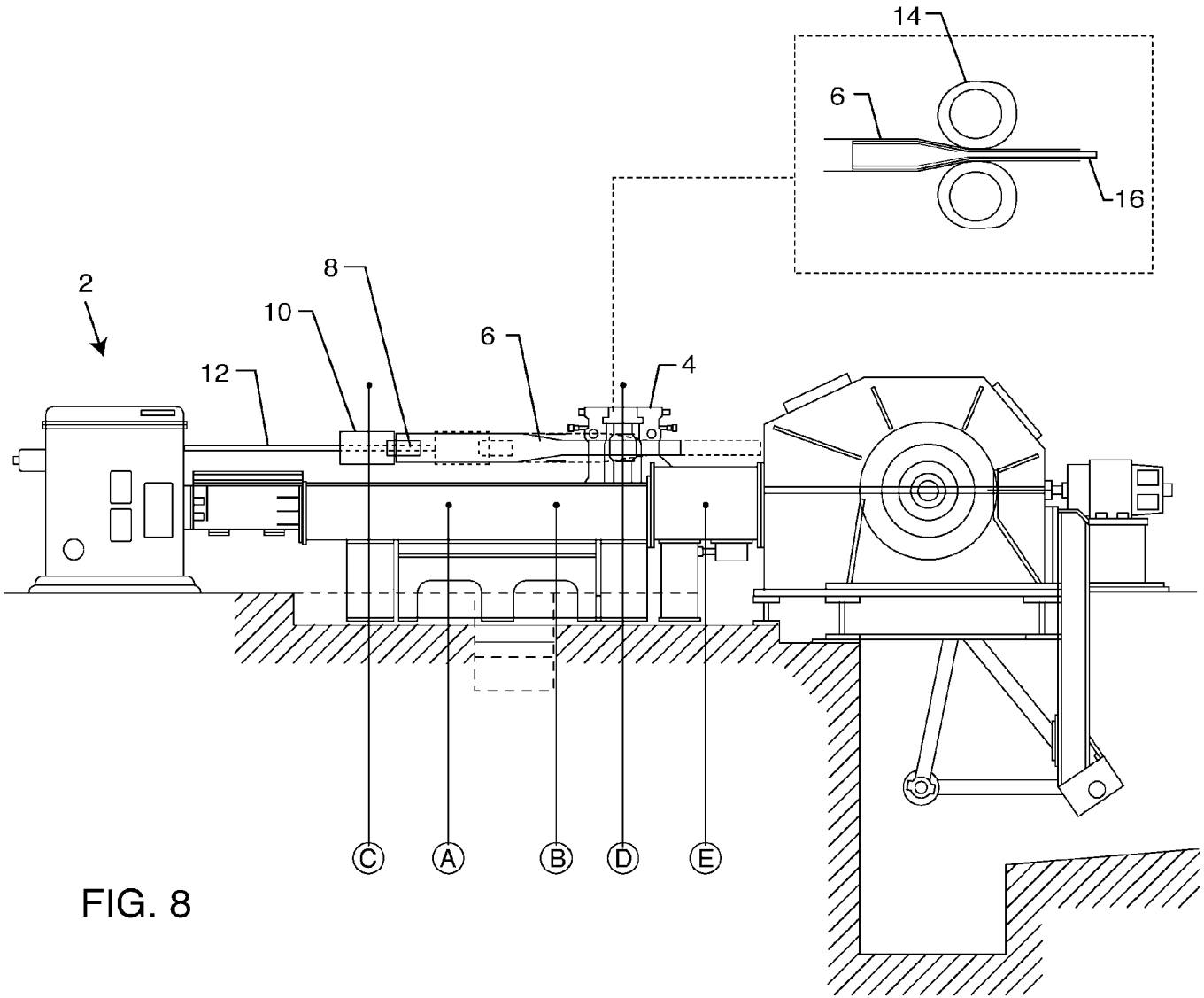
FIG. 8 is a diagrammatic view of the pilger mill of FIG. 7, but illustrating the forming of a handle and taper sections.

With reference now to FIG. 3, the tube shell is now ready for a tube reduction process, wherein a tapered or trumpet section as well as a handle section are to be formed. The tube feed and saddle assemblies of the pilger mill are moved into their start positions (300). That is, the tube feed carriage assembly 10 is moved into position A, and simultaneously the saddle assembly 4 is moved into the B position, as illustrated in FIGS. 7 and 8. An undrawn end, or larger diameter end, of the tube shell is inserted into a full set of ring dies 14 over a mandrel 16, which is connected to the mandrel rod 12 (302). More particularly, the undrawn end of the tube shell 6 is inserted from the E direction, as illustrated in FIG. 7. The tube shell 6 is then put full into the inside diameter tube clamp device 8, as illustrated in FIG. 8, of the tube feed carriage assembly (304). The internal diameter tube clamp is activated to secure the tube shell in place (306). The tube carriage assembly 10 is retracted to the C position, and simultaneously the saddle assembly 4 is retracted to the D position (308).

A tube reducing process is then started. During this process, a full-ring die set is rocked back and forth along the longitudinal axis of a pilger. The saddle assembly 4 is allowed to freely rock back and forth while the tube feed carriage assembly 10 stops feeding the tube shell 6 into the full ring die set 14, but the inside diameter tube clamp 8 continues to rotate the tube shell 6 (310). More particularly, the tube shell 6 is rotated approximately ⅛ of its diameter, or approximately 41 degrees, and advanced about one-fourth of an inch into the full-ring die set 14 per each stroke until the required length and shape of the baseball/softball bat shell is achieved. This rocking back and forth typically takes five to ten seconds. The full-ring die set must actually reduce the outer diameter and wall thickness of the tube shell 6 over the mandrel 16 in the same direction of material flow. That is, the material flow is allowed to flow in the same direction of the work load during tube forming strokes. During this process, the inside tube clamp 8 continues to rotate the tube shell 6 to provide a certain roundness for the tube shell 6, although this roundness will be corrected in later processes.

The pilger is then stopped, and the saddle assembly 4 and carriage assembly 10 are returned to their starting positions (312). More particularly, the tube feed carriage assembly 10 is returned to the A position, and the saddle assembly 4 is returned to the B position. The inside diameter tube clamp 8 is then activated so as to release the tube shell 6 (314). The treated tube shell 6 can then be manually removed from the tube feed carriage assembly 10 towards the E direction. The treated shells are then cleaned and annealed (316).

Figure 4:
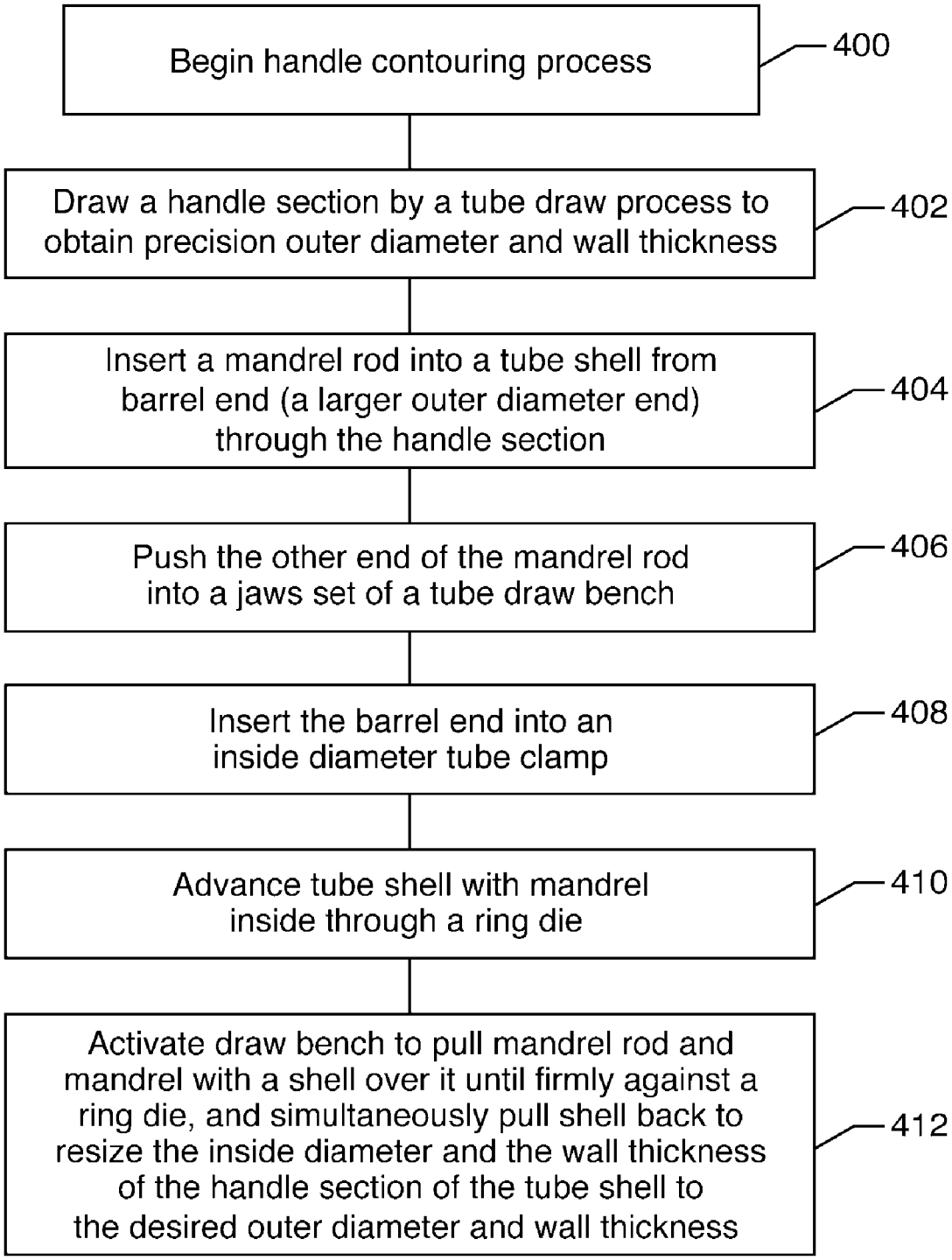
FIG. 4 is a flow chart depicting the steps taken in accordance with the present invention to draw a handle section of the metal bat.
Figure 9:
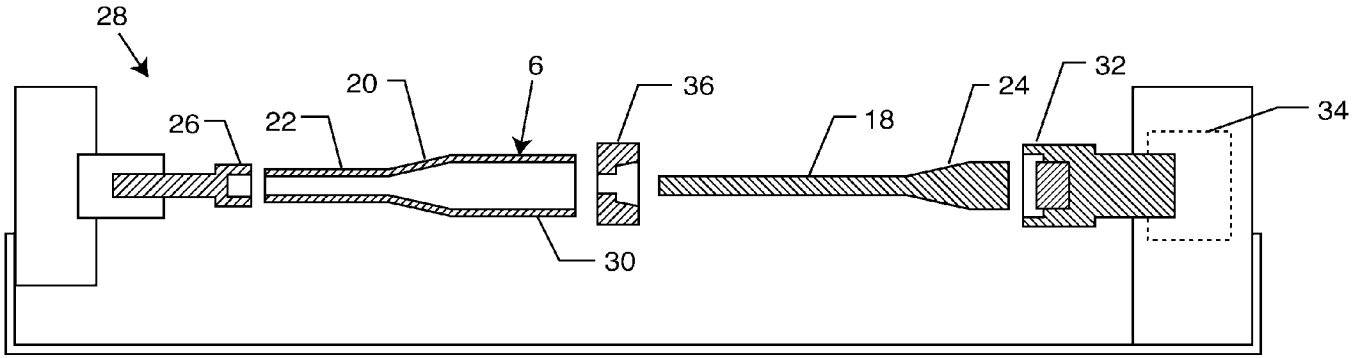
FIGS. 9-11 are cross-sectional diagrammatic views of components of a draw bench used to draw the handle section of the metal bat, in accordance with the present invention.
Figure 10:
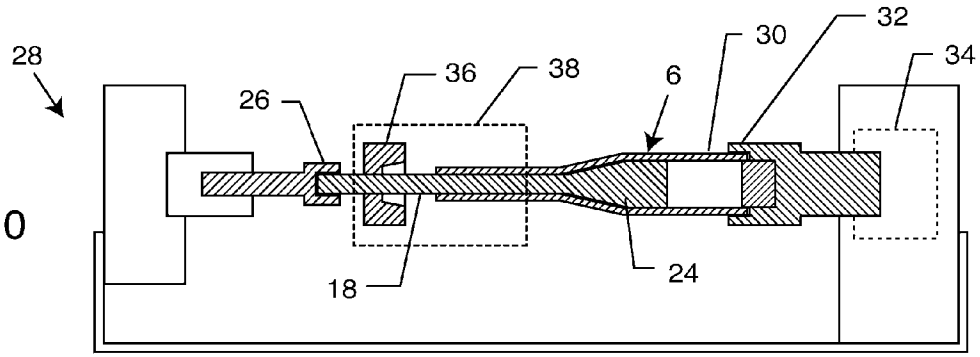
Figure 11:
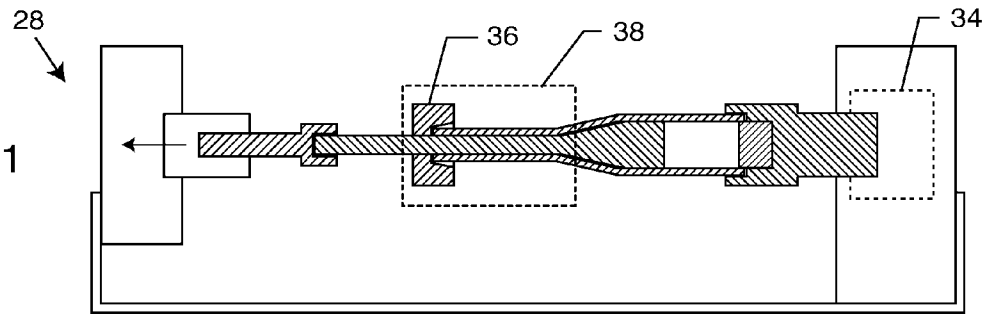

With reference now to FIG. 4, the handle contouring process then begins (400) by drawing a handle section by a tube draw process to obtain precision outer diameter and wall thickness (402). This is illustrated in FIGS. 9-11. A mandrel rod 18 is inserted into the tube shell 6 from the barrel or larger outer diameter end, and through the handle section (404). As illustrated in FIG. 9, after the previously illustrated and described pilgering process, the tube shell 6 has an intermediate tapered section 20, also referred to as a trumpet, as well as an elongated and smaller diameter handle section 22.

The mandrel rod 18, which is connected to a tapered mandrel 24, is inserted into the tube shell 6 from the larger outer diameter end through the handle section, as illustrated in FIG. 10. The end of the mandrel rod 18 is pushed into a jaws set 26 of the tube draw bench 28 (406).

The larger outer diameter barrel end 30 of the tube shell 6 is then inserted into an inside diameter tube clamp 32 of the draw bench 28 (408). With the tapered section of the mandrel 24 located inside the tapered section 20 of the tube shell 6, approximately one-half of an inch of the barrel end 30 is clamped inside the inside diameter tube clamp 32, which is connected to a cylinder rod 34 of the tube draw bench 28.

The tube shell 6 is then advanced with the internal mandrel inside through a die ring 36 (410). The die ring 36 is located inside of a die block 38 of the draw bench 28. The draw bench is then activated to pull the mandrel rod 18 and mandrel 24 with the conformed tube shell 6 over it until firmly against the ring die 36. Simultaneously, the shell 6 is pulled back to resize the inside diameter and the wall thickness of the handle section 22 of the tube shell 6 to the desired outer diameter and wall thickness (412). The shell 6 is then removed from the inside diameter tube clamp 32.

Figure 5:
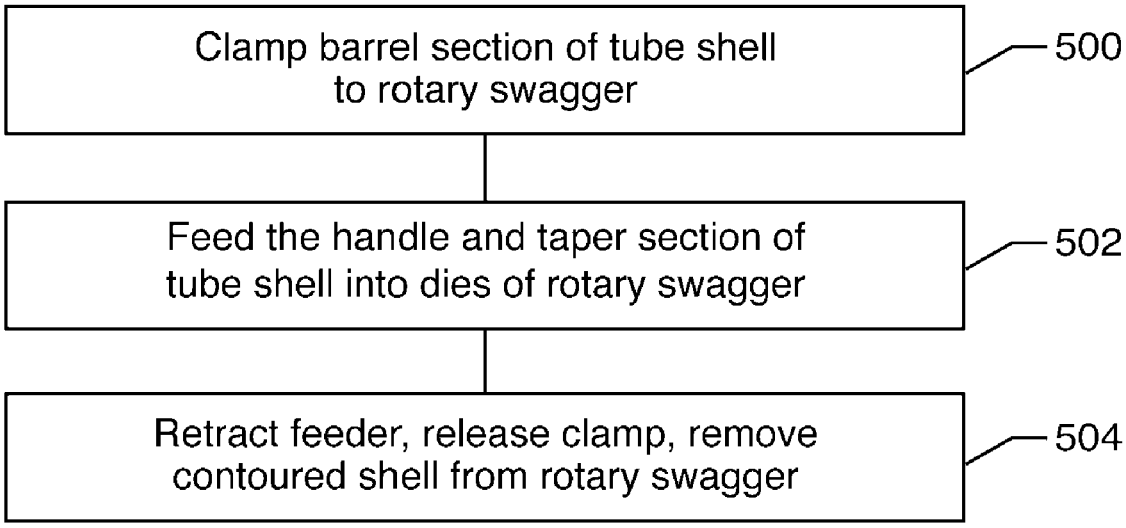
FIG. 5 is a flow chart depicting the steps taken in accordance with the present invention to swage the handle and taper sections of the tube shell.

With reference now to FIG. 5, after the handle section 22 of the shell 6 has been drawn using the drawing bench and draw process described above, the shell 6 is subjected to a swaging process using a rotary swagger machine 40, such as that illustrated in FIG. 12. The swagger machine 40 includes at least two, and preferably four, dies at an innermost portion thereof. The dies 42, as illustrated in FIG. 13, are configured so as to shape the tapered section 20 and handle section 22 of the shell 6 in the desired configuration. Thus, as illustrated in FIG. 13, the dies 42 are also tapered. Each die 42 is disposed adjacent to a hammer 44, an external edge thereof 46 having a curvature. This outer curved edge 46 comes into contact with peripheral rollers 48 disposed within the housing 50 of the rotary swagger 40. Thus, as the rotary swagger 40 is actuated, when the rollers 48 contact the apex of the outer surface 46, this causes the die to move inward and compress against the shell 6. When the hammer 44 is moved and rotated, the sloping surface will cause the hammer and die 44 and 42 to move away from the working surface. Thus, there is a multidirectional force applied to the working surface of the shell 6.

Rotary swaging is a process of shaping work with many blows applied by the rotating dies 42. The dies 42 reciprocate rapidly as the spindle on which they are mounted rotates. Swaging is particularly applicable to pointing, tapering, and reducing in size operations, and thus is particularly adapted for the final process for forming the tapered section 20 and handle 22 of the shell 6 which is being formed into a bat. Because swaging is a hammer operation, it has the same beneficial effect on work as forging. It produces a desirable grain structure and results in increased tensile strength and elasticity. Cold swaging work hardens most materials. Another advantage of swaging is the conservation of material, the material being shaped by hammering and there is no waste except final trimming of the ends of the work piece. Moreover, swaging is fast, typically only requiring a few seconds. In tube swaging without a mandrel, part of the metal flow is inward, increasing the wall thickness of the tube, which is desirable for the handle 22 or trumpet 20 sections.

With reference now to FIG. 5, the barrel section 30 of the tube shell 6 is clamped to the rotary swager 40 (500). An internal clamp is preferably used which is connected to the end of an air or hydraulic cylinder of the rotary swager (not shown) and into the barrel section 30 of the tube shell 6 to internally clamp the tube shell, as described above with previous processes. The feeding distance of the rotary swager 40 is previously set up so as to feed the shell 6 a predetermined distance into the rotary swager 40. The handle 22 and taper 20 sections of the tube shell 6 are fed into the dies 42 of the rotary swager 40 (502). Due to the succession of rapid hammer blows by the dies 42, the tube shell tapered and handle sections 20 and 22 are contoured to the desired shape and a perfect roundness. The feeder is then retracted, the clamp released, and the contoured shell is removed from the rotary swager (504).

Figure 6:
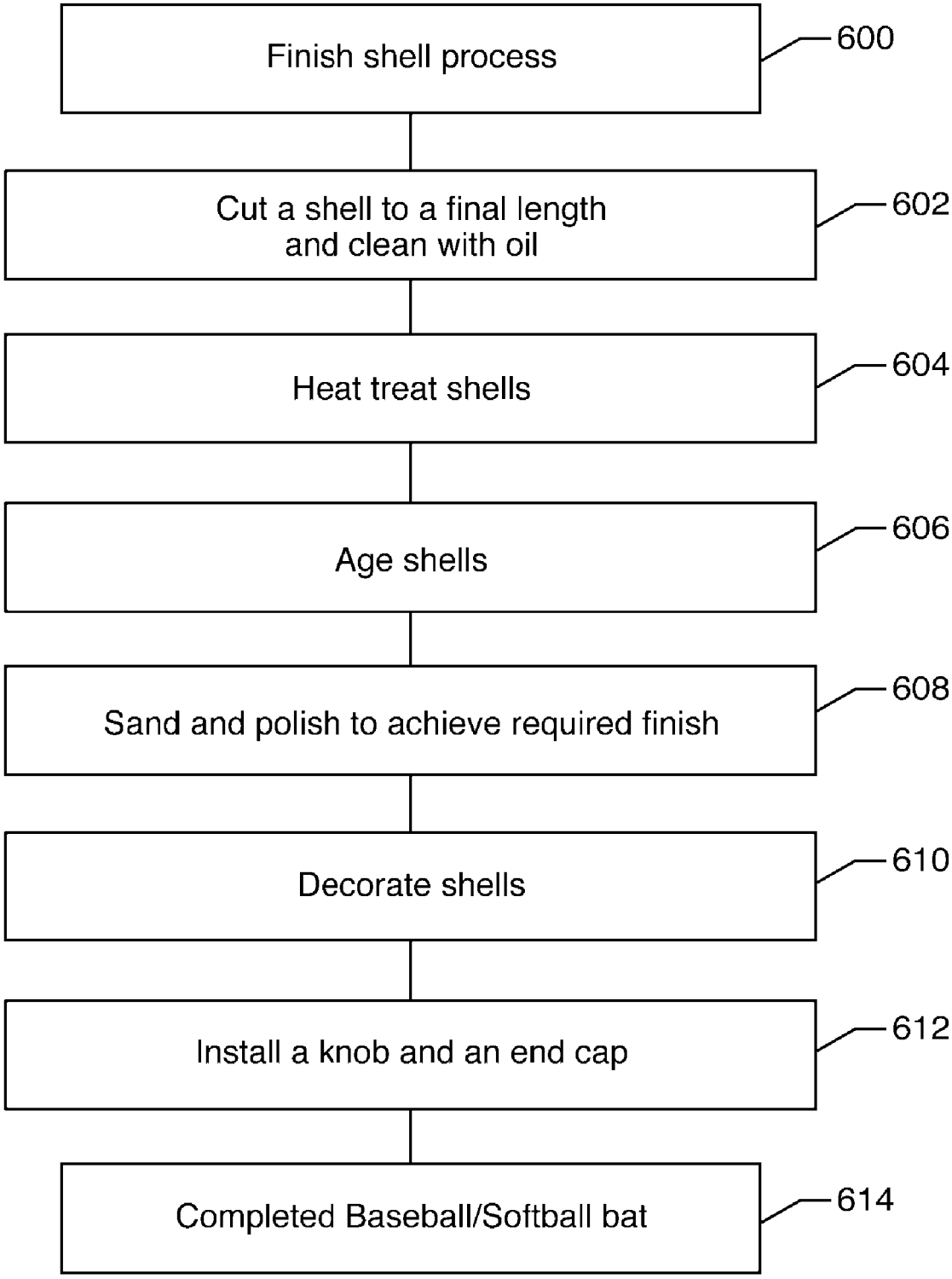
FIG. 6 is a flow chart depicting the steps for finishing and completing the metal bat in accordance with the present invention.

With reference now to FIG. 6, the shell process is then finished (600) by cutting the shell to a final length, such as by trimming opposite ends thereof, and cleaning with oil (602). The shells 6 are then heat treated (604) and aged (606). The shells are then sanded and polished to achieve the required finish (608) and decorated (610). As a final step, a knob is attached to the end of the handle section 22 and an end cap to the end of the barrel section 30 (612). This concludes the baseball or softball bat (614).

To summarize, a tube shell is preformed in a tubular shape with a pilger mill. The tube shell is drawn into a tubular shape with a draw bench to obtain precise shell uniformity and outside diameter. This draw is also used to refine the grain structure of aluminum alloy to gain superior mechanical strength. The handle and tapered sections are then formed for a bat with a pilger mill in such a manner that material flows in the same direction of the forming action. The handle section is then drawn to obtain precise uniformity and outside diameter. Finally, the bat is subjected to a swaging process to obtain perfect roundness and smooth contour.

Although an embodiment has been described in detail for purposes of illustration, various modifications may be made without departing from the scope and spirit of the invention.

What is claimed is:

1. A process for manufacturing a hollow metal ball bat, comprising the steps of:

forming a shell into a tubular shape using a pilger mill;

reducing a wall thickness of the tube shell by drawing the tube shell with a draw bench;

creating a handle section and a taper section using the pilger mill;

drawing the handle section using the draw bench; and swaging the handle and taper sections of the tube shell.

2. The process of claim 1, wherein the forming step comprises the steps of forming the shell into the tubular shape having a generally uniform outer diameter and wall thickness.

3. The process of claim 2, including the step of cutting the tube shell into predetermined lengths.

4. The process of claim 1, wherein the reducing step includes the steps of drawing the tube shell over a mandrel.

5. The process of claim 4, including the step of annealing the tube shell after the reducing step.

6. The process of claim 1, wherein the creating step includes the steps of rotating the tube shell along a longitudinal axis thereof as a full-ring die set of the pilger mill is actuated along a length of the tube shell.

7. The process of claim 6, wherein the tube shell is rotated step-wise in approximately 41 degree increments while being advanced into the die set.

8. The process of claim 6, wherein the full-ring die set is actuated along the length of the tube shell for between 5 and 15 seconds.

9. The process of claim 6, wherein the full-ring die set is actuated along the length of the tube shell in such a manner so as to cause material flow of the tube shell in the same direction of work load during actuation strokes of the die set.

10. The process of claim 1, including the steps of cleaning and annealing the tube shell after the creating step.

11. The process of claim 1, wherein the handle drawing step includes the step of advancing the tube shell having a mandrel disposed therein through a die ring located inside of a die block of the draw bench.

12. The process of claim 1, including the steps of cutting the tube shell to a final length after the swaging step, and heat treating the shells.

13. The process of claim 12, including the steps of attaching a knob onto a handle end of the tube shell and an end cap on an opposite end of the tube shell.

14. The process of claim 1, including the step of using an internal diameter tube clamp device to clamp the tube shell in the pilger mill.

15. A process for manufacturing a hollow metal ball bat, comprising the steps of:

forming a shell into a tubular shape having a generally uniform outer diameter and wall thickness using a pilger mill;

drawing the tube shell over a mandrel of a draw bench to reduce the wall thickness of the tube shell;

creating a handle section and a taper section using the pilger mill, including the steps of rotating the tube shell along a longitudinal axis thereof as a full-ring die set of the pilger mill is actuated along a length of the tube shell, wherein the full-ring die set is actuated along the length of the tube shell in such a manner so as to cause material flow of the tube shell in the same direction of work load during actuation strokes of the die set;

drawing the handle section using the draw bench; and swaging the handle and taper sections of the tube shell.

16. The process of claim 15, including the step of cutting the tube shell into predetermined lengths.

17. The process of claim 15, including the step of annealing the tube shell after the reducing step.

18. The process of claim 15, wherein the tube shell is rotated step-wise in approximately 41 degree increments while being advanced into the die set.

19. The process of claim 15, wherein the full-ring die set is actuated along the length of the tube shell for between 5 and 15 seconds.

20. The process of claim 15, including the steps of cleaning and annealing the tube shell after the creating step.

21. The process of claim 15, wherein the handle drawing step includes the step of advancing the tube shell having a mandrel disposed therein through a die ring located inside of a die block of the draw bench.

22. The process of claim 15, including the steps of cutting the tube shell to a final length after the swaging step, and heat treating the shells.

23. The process of claim 22, including the steps of attaching a knob onto a handle end of the tube shell and an end cap on an opposite end of the tube shell.

24. The process of claim 15, including the step of using an internal diameter tube clamp device to clamp the tube shell in the pilger mill.

* * * * *